US005146044A

United States Patent [19]

Kurokawa et al.

[11] Patent Number: 5,146,044

[45] Date of Patent: Sep. 8, 1992

[54] WIRELESS DETONATOR

[75] Inventors: Koichi Kurokawa; Kenji Hashimoto, both of Chita, Japan

[73] Assignee: Nippon Oil and Fats Co., Ltd., Tokyo, Japan

[21] Appl. No.: 773,125

[22] Filed: Oct. 7, 1991

[30] Foreign Application Priority Data

Oct. 9, 1990 [JP] Japan ..... 2-271182

[51] Int. Cl.[5] ..... F42C 19/08

[52] U.S. Cl. ..... 102/202.5; 102/200

[58] Field of Search ..... 102/200, 202.5

[56] References Cited

U.S. PATENT DOCUMENTS 4,615,268 10/1986 Nakano et al. ..... 102/200
4,869,170 9/1989 Dahmberg et al. ..... 102/200

FOREIGN PATENT DOCUMENTS 3131332 4/1982 Fed. Rep. of Germany .
61-57558 12/1986 Japan .
63-56480 11/1988 Japan .

*Primary Examiner*—Charles T. Jordan
*Attorney, Agent, or Firm*—Stetina and Brunda

[57] ABSTRACT

A wireless detonator is disclosed that includes an antenna for receiving microwaves, a detonator provided with a heating element, and a transmission circuit. The heating element in the detonator is heated by the energy of the microwaves. The transmission circuit transmits the microwave energy from the antenna directly to the heating element. The antenna has a relative gain of 0 to 20 dB in the frequency band of the microwaves. The absolute value of the reactance component in the radiation impedance of the antenna is at most 50% of the pure resistance component of that impedance. The absolute value of the reactance component in the impedance of the heating element is at most 50% of the pure resistance component of that impedance. The pure resistance components of the radiation impedance of the antenna and of the impedance of the heating element are in a range of 70 to 130% of the characteristic impedance of the transmission circuit.

6 Claims, 1 Drawing Sheet

WIRELESS DETONATOR

BACKGROUND OF THE INVENTION

1. Field of the Invention

The present invention relates to a detonator for blasting rocks, more particularly to a wireless detonator which utilizes microwaves to cause detonations.

2. Description of the Related Art

Devices which directly activate detonators using received microwaves are well known as conventional radio detonator devices. For example, Examined Japanese Patent Publication No. 61-57558 discloses such a device.

In this device, as shown in FIG. 2, microwave energy received by an antenna 11 is supplied directly to a heating element 13 in a detonator 14 by a transmission circuit 12. Then, the heating element 13 is heated to ignite an igniter, thus triggering the detonator 14.

It is necessary for this device to match the radiation impedance of the antenna 11, the characteristic impedance of the transmission circuit 12, and the impedance of the heating element 13 with each other in FIG. 2. If the radiation impedance of the antenna 11 is not matched with the characteristic impedance of the transmission circuit 12, most of the received microwave energy is reflected at the junction between the antenna 11 and the transmission circuit 12, so that the energy will not be properly carried through. Similarly, if the characteristic impedance of the transmission circuit 12 is not matched with the impedance of the heating element 13, once again, most of the received microwave energy will be reflected at the junction of the transmission circuit 12 and the heating element 13. In both cases, the received microwave energy is not efficiently supplied to the heating element 13. Accordingly, the detonator 14 will not therefore ignite in either case.

A specific description will now be given of the case where a coaxial cable is used as the transmission circuit 12, and a platinum bridge wire serves as the heating element 13 in the device shown in FIG. 2.

The characteristic impedance of a generally used conventional coaxial cable is 50Ω or 75Ω. The impedance of a platinum bridge wire is about $(0.22+j17)\ \Omega$ for microwaves of for example 2.45 GHz. Almost all of the microwave energy is therefore reflected at the junction between the coaxial cable and the platinum bridge wire, so that the energy cannot be efficiently supplied to the platinum bridge wire, causing a misfire of the detonator.

An initiating device disclosed in Japanese Patent Publication No. 63-56480 is shown in FIG. 3. In such a device microwaves received by an antenna 22 are tuned by a tuning circuit 21, which outputs a microwave current. A charging circuit 23 rectifies the microwave current, and charges an igniting capacitor. When the irradiation of the microwaves is completed, a pulse generator 24 generates a trigger pulse. In response to the trigger pulse, an igniter circuit 25 discharges the igniting capacitor of the charging circuit 23 to heat a heating element 26. As a result, the igniter will ignite to trigger a detonator 27.

The impedance matching need not be considered in the above device because the charging circuit 23 rectifies the microwave current. The above-described device however has a complicated structure and requires many circuits.

This initiating device is charged during the irradiation of the microwaves, generates a trigger pulse immediately upon completion of the irradiation, and supplies a current to the detonator 27 to ignite it. The microwaves therefore have to be irradiated for a long time (e.g. 5 to 50 sec). This long irradiation will have an adverse effect on human bodies, animals, and plants, as well as other machinery. To use a detonator of the type described above, some countermeasures should be taken, such as providing workers with protectors or installing protective barriers. Accordingly, the efficiency in blasting work drops.

SUMMARY OF THE INVENTION

It is therefore an object of the present invention to provide a wireless detonator having an antenna, a transmission circuit and a detonator, and which allows the radiation impedance of the antenna, the characteristic impedance of the transmission circuit and the impedance of the heating element to be matched with each other, and which has an excellent energy transmission efficiency.

It is another object of the present invention to provide a wireless detonator which is designed simple and highly accurate, and has excellent stability in various characteristics, requires a very short exposure time to microwaves to prevent an adverse effect on the use environment, and which surely responds to small microwave energy input to be activated.

To achieve these objects, a wireless detonator according to the present invention includes an antenna for receiving microwaves. The heating element in the detonator is heated by the energy of the microwaves. The transmission circuit transmits the microwave energy from the antenna directly to the heating element. The antenna has a relative gain of 0 to 20 dB in the frequency band of the microwaves. The absolute value of the reactance component in the radiation impedance of the antenna is less than or equal to 50% of the pure resistance component of that impedance. The absolute value of the reactance component in the impedance of the heating element is at most 50% of the pure resistance component of that impedance. The pure resistance components of the radiation impedance of the antenna and of the impedance of the heating element are in a range of 70 to 130% of the characteristic impedance of the transmission circuit.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiment together with the accompanying drawings in which:

DETAILED DESCRIPTION OF THE PREFERRED EMBODIMENT

A preferred embodiment of the present invention will now be described referring to the accompanying drawings.

Figure 1:
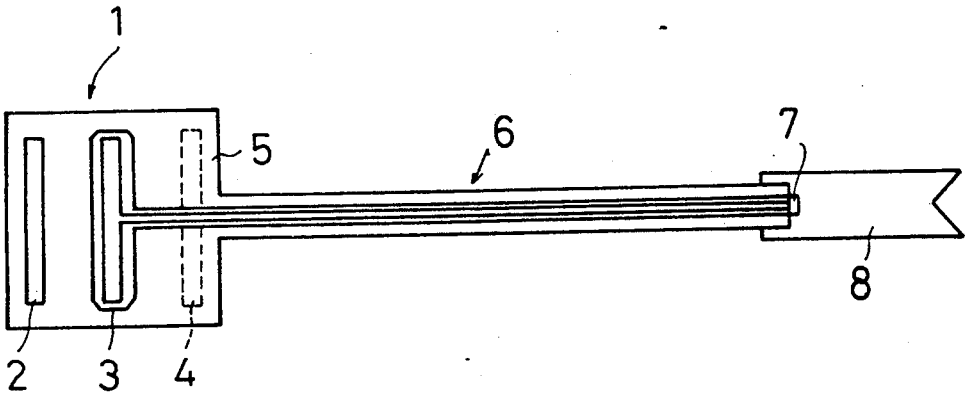
FIG. 1 is an explanatory diagram showing an example of a wireless detonator embodying the present invention.

A wireless detonator shown in FIG. 1 has a cylindrical detonator 8 containing a heating element 7. An antenna 1 and a transmission circuit 6 are integrally formed on a print circuit board 5. The heating element 7 is jointed to the end of the transmission circuit 6. The antenna 1, a Yagi antenna, includes a wave director 2, a radiator 3 and a reflector 4.

The size of the antenna 1 depends on the wavelength. Considering the desired size of the antenna 1, the radio waves for use in the wireless detonator are microwaves having a frequency in the range of 1 to 30 GHz. The frequency may preferably be 1 to 3 GHz, and more preferably 2.3 to 2.6 GHz.

In the wireless detonator according to the present invention, the microwaves of, for example, 1 to 10 kW are irradiated to the antenna 1 for 2 to 10 ms. The antenna 1 thus receives about 10 to 100 W of microwave energy which is efficiently supplied to the heating element 7 through the transmission circuit 6. The heating element 7 is heated to trigger the wireless detonator 8.

A relative antenna gain in the range of 0 to 20 dB is suitable to provide the antenna 1 with sufficient energy to activate the detonator. Although a higher gain would be desirable, the structure of the antenna 1 that is required to support such gains becomes complicated. A preferable relative gain is therefore in the range of 5 to 10 dB. The antenna 1 shown in FIG. 1 has a relative gain of 6 to 7 dB in the frequency band of 2.3 to 2.6 GHz.

The energy transmission efficiency of the antenna 1 drops as a function of increases in the absolute value of the reactance component of the antenna's radiation impedance. The absolute value of the reactance component therefore has to be less than or equal to 50% of the pure resistance component of the impedance. The absolute value is preferably less than or equal to 40% of the pure resistance component. The smaller the value of the reactance is (the value can be "0"), the better the energy transmission efficiency becomes. The radiation impedance of the antenna 1 shown in FIG. 1 is $(96+j28)\ \Omega$. The absolute value of the reactance component is 29% of the pure resistance component in this case.

It is preferable that the characteristic impedance of the transmission circuit 6 always be constant whether in a high-frequency band, or when the length of the transmission circuit 6 is changed. For example, general coaxial cords, 3C2V (characteristic impedance of $75\Omega$) and 5D2V (characteristic impedance of $50\Omega$), both specified in JIS C 3501, a coaxial cable for a TV antenna, or a twin-lead type cable for a high frequency may be used as the transmission circuit 6.

The transmission circuit 6 in FIG. 1 is a twin-lead type strip line formed on the print circuit board 5, and has a characteristic impedance of $89\Omega$. The length of the transmission circuit 6 can be properly determined according to the depth of a bore formed in the rock.

As the absolute value of the reactance component in the impedance of the heating element in the detonator becomes greater, the efficiency in energy transmission will decrease, as in the case of the antenna. The absolute value of the reactance component therefore has to be at most 50% of the pure resistance component in the impedance. The absolute value is preferably less than or equal to 40% of the pure resistance component. The smaller the value is, the better the energy transmission efficiency becomes. Again, the value can be "0". A chip resistor is used as the heating element 7 in FIG. 1. The chip resistor has an excellent frequency response, and provides a highly accurate impedance at any time. The impedance of the chip resistor is $(91+j15)\ \Omega$ at the frequency of 2.45 GHz, and the absolute value of the reactance component is 14% of the pure resistance component.

Other than the chip resistor, devices which satisfy the above conditions for the impedance, may also be used as the heating element in the detonator. For example, it is possible to use a heating element in which a conductive material, such as silver powder or carbon, is blended with an igniter and the mixture is kneaded.

To prevent the reflection of the microwave energy as much as possible at the junctions between the antenna and the transmission circuit, and between the transmission circuit and the heating element, the pure resistance components of the radiation impedance of the antenna and of the impedance of the heating element have to be in a range of 70 to 130% and more preferably 85 to 115% of the characteristic impedance of the transmission circuit.

In the wireless detonator shown in FIG. 1, the pure resistance component ($98\Omega$) of the radiation impedance of the antenna 1 is 8% greater than the characteristic impedance ($89\Omega$) of the transmission circuit 6 while the pure resistance component ($91\Omega$) of the impedance of the heating element 7 is 2% greater than the same characteristic impedance.

In the embodiment shown in FIG. 1, the antenna and the transmission circuit are formed on the same printed circuit board. They therefore have a very small production errors and are highly accurate and stable in characteristics.

Such materials as epoxy paper, epoxy glass, bakelite, and teflon may be used for the printed circuit board. The general-purpose epoxy glass is most preferable. The thickness of the printed circuit board can be determined to meet the purpose. In the case where the end of the transmission circuit is inserted into the detonator of 6 mm in internal diameter, for example, the printed circuit board is preferably 1 to 3 mm thick.

TEST EXAMPLES AND COMPARATIVE EXAMPLES

The characteristics of the wireless detonator of the present invention will now be described specifically referring to test examples and comparative examples.

To study the characteristics of the detonator, bores were formed in a three by three lattice, i.e., nine bores in total were made in the rock in an unlined tunnel. In each bore was placed the wireless detonator with its antenna protruding from the bore.

The detonation test was conducted in such a way that microwaves were irradiated from a solenoid-horn type microwave irradiator to wireless detonators. The microwave irradiator was placed 1 m away from the surface of the rock.

The microwave irradiator for industrial use had a frequency of 2.45 GHz and an output of a 5-kW. The opening of the irradiator was 181.5 mm$\times$122 mm, and the irradiation time was 5 ms.

TEST EXAMPLE 1

The Yagi antenna A shown in FIG. 1 was used as an antenna for the wireless detonator. The configuration of the wireless detonator was determined as follows in consideration of the frequency, 2.45 GHz, and the contraction ratio of the microwaves to be irradiated. The wavelength of electromagnetic waves is generally varied depending on transmission environments, for example, in a space and on printed circuit boards. Therefore, when the printed circuit boards are used as the antenna for transmitting electromagnetic waves, it is necessary to adjust the size of elements of the antenna. The above contraction ratio is the ratio of the wavelength transmitted on the printed circuit boards to the wavelength transmitted in the space. The results of the blasting test are given in Table 1.

Antenna 1

Length of wave director 2: 41.1 mm
Length of radiator 3: 48.5 mm
Length of reflector 4: 49.5 mm
Width of each element: 1 mm
Interval between wave director 2 and radiator 3: 10.7 mm
Interval between radiator 3 and reflector 4: 20.5 mm
Relative gain: 6 dB

Transmission circuit 6

Length of circuit: 300 mm
Width of circuit: 1 mm
Interval between circuits: 0.3 mm

Printed circuit board 5

Epoxy glass board
(1 mm thick)

Heating element 7

Type: Chip resistor (a)
Impedance: $(91+j15)\Omega$

Test Examples 2 to 4

In the individual Test Examples 2 to 4, the heating element 7 in the wireless detonator was changed to a chip resistor (b) or (c) with the characteristics shown in Table 1, or a heating element containing silver powder. The other configuration of the detonator and the test conditions are the same as those in Test Example 1. The test results are also shown in Table 1.

TEST EXAMPLES 5 AND 6

In Test Examples 5 and 6, the transmisson circuit 6 and heating element 7 in the wireless detonator were changed as indicated in Table 2. The other configuration of the detonator and the test conditions are the same as those in Test Example 1. The test results are given in Table 2.

TEST EXAMPLES 7 AND 8

In Test Examples 7 and 8, the antenna 1, the transmission circuit 6 and heating element 7 in the wireless detonator were changed as specified in Table 2. The other configuration of the detonator and the test conditons are the same as those in Test Example 1. The test results are also shown in Table 2.

The impedances of the antenna, the transmission circuit and the heating element are respectively expressed by the following formulae in Tables 1 and 2, and values in those tables correspond to the individual symbols.

$R+jX$ ($\Omega$),
$Z$ ($\Omega$), and
$R+jX$ ($\Omega$)

The ratio of the number of tested detonators to the number of activated detonators is given as a test result.

As shown in Tables 1 and 2, the explosion tests were conducted under the individual conditions as mentioned in Examples 1 to 8, and all the nine tested detonators were set off.

Comparative Examples 1 to 3

In Comparative Examples 1 to 3, the heating element 7 in the wireless detonator was changed as shown in Table 3. The other configuration of the detonator and the test conditions are the same as those in Test Example 1. The test results are shown in Table 3.

As is apparent from Table 3, eight out of nine tested detonators were set off in Comparative Example 1, while only six out of nine detonators functioned in Comparative Example 2. In Comparative Example 3, all the nine detonators misfired.

Comparative Example 4

In Comparative Example 4, the transmission circuit 6 in the wireless detonator was changed as shown in Table 3. The other configuration of the detonator and the test conditions are the same as those in Test Example 1. The test results are also shown in Table 3.

As is apparent from Table 3, three out of the nine tested detonators were activated, the remaining detonators having failed.

COMPARATIVE EXAMPLES 5 AND 6

The antenna 1, the transmission circuit 6 and the heating element 7 in Comparative Example 5, had quite different configuration from those in Comparative Example 6 as shown in Table 4. The test conditions are the same as those in Test Example 1.

Figure 2:
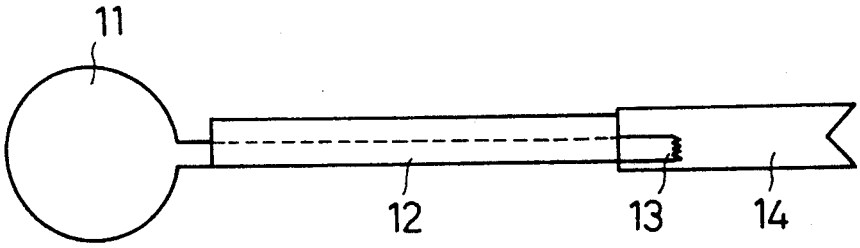
Fig. 2 (Prior Art)
FIG. 2 is a diagram illustrating a conventional device which directly triggers a detonator by received microwaves.

Particularly, a conventional half-wavelength dipole antenna or a conventional loop antenna (see FIG. 2) with a reaction impedance of $(21+j3)\Omega$ and a relative gain of $-0.5$ dB was used as the antenna 1. As is apparent from Table 4, nine detonators all failed in both Comparative Examples 5 and 6.

COMPARATIVE EXAMPLE 7

Figure 3:
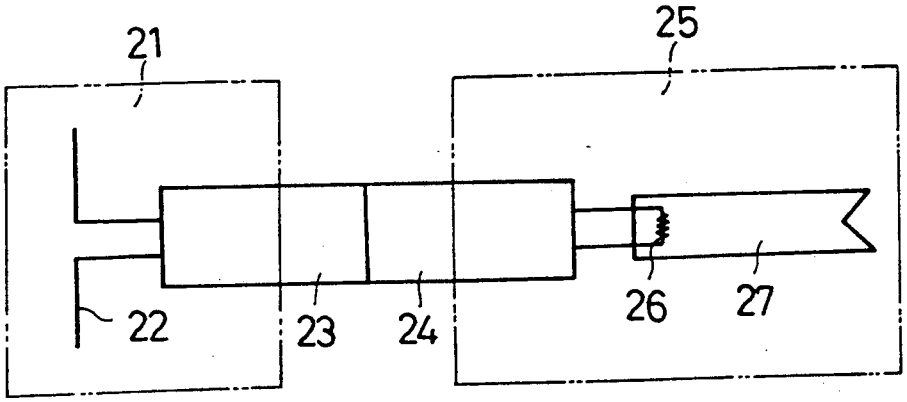
Fig. 3 (Prior Art)
FIG. 3 is a diagram illustrating another conventional device which activates a detonator after received microwaves are temporarily charged.

The test was conducted using the conventional initiating device shown in FIG. 3 in the same manner as in the test examples. The nine detonators all failed when the irradiation time was 5 ms. The test was again conducted in the same manner as before with an irradiation time of 5 seconds, and all the detonators were set off. The irradiation time until the detonation had to be set longer.

TABLE 1

| | | Example | | | |
|---|---|---|---|---|---|
| | | 1 | 2 | 3 | 4 |
| | | Antenna | | | |
| Type | | Yagi antenna A | Yagi antenna A | Yagi antenna A | Yagi antenna A |
| Relative gain | | 6 | 6 | 6 | 6 |
| Radiation imped- | R | 96 | 96 | 96 | 96 |
| | X | 28 | 28 | 28 | 28 |
| | X/R | 0.29 | 0.29 | 0.29 | 0.29 |

TABLE 1-continued

| | | Example | | | |
|---|---|---|---|---|---|
| | | 1 | 2 | 3 | 4 |
| ance | | | | | |
| Transmission circuit | | | | | |
| Type | | strip line | strip line | strip line | strip line |
| Characteristic impedance | Z | 89 | 89 | 89 | 89 |
| Heating element | | | | | |
| Type | | chip resistor a | chip resistor b | chip resistor c | silver powder-containing heating element |
| Impedance | R | 91 | 112 | 65 | 64 |
| | X | 15 | 39 | 21 | 31 |
| | X/R | 0.14 | 0.35 | 0.32 | 0.48 |
| Number of detonations/ Number of tested detonators | | 9/9 | 9/9 | 9/9 | 9/9 |

TABLE 2

| | | Example | | | |
|---|---|---|---|---|---|
| | | 5 | 6 | 7 | 8 |
| Antenna | | | | | |
| Type | | Yagi antenna A | Yagi antenna A | Yagi antenna B | Half-wave-length dipole antenna |
| Relative gain | | 6 | 6 | 5 | 0 |
| Radiation impedance | R | 96 | 96 | 60 | 71 |
| | X | 28 | 28 | 28 | 0 |
| | X/R | 0.29 | 0.29 | 0.47 | 0 |
| Transmission circuit | | | | | |
| Type | | coaxial cable I | coaxial cable I | coaxial cable II | coaxial cable I |
| Characteristic impedance | Z | 75 | 75 | 50 | 75 |
| Heating element | | | | | |
| Type | | chip resistor a | chip resistor c | silver powder-containing heating element | chip resistor c |
| Impedance | R | 91 | 65 | 61 | 64 |
| | X | 15 | 21 | 31 | 21 |
| | X/R | 0.14 | 0.32 | 0.48 | 0.32 |
| Number of detonations/ Number of tested detonators | | 9/9 | 9/9 | 9/9 | 9/9 |

TABLE 3

| | | Comp. Example | | | |
|---|---|---|---|---|---|
| | | 1 | 2 | 3 | 4 |
| Antenna | | | | | |
| Type | | Yagi antenna A | Yagi antenna A | Yagi antenna A | Yagi antenna A |
| Relative gain | | 6 | 6 | 6 | 6 |
| Radiation impedance | R | 96 | 96 | 96 | 96 |
| | X | 28 | 28 | 28 | 28 |
| | X/R | 0.29 | 0.29 | 0.29 | 0.29 |
| Transmission circuit | | | | | |
| Type | | strip line | strip line | strip line | coaxial cable II |
| Characteristic impedance | Z | 89 | 89 | 89 | 50 |
| Heating element | | | | | |
| Type | | chip resistor d | chip resistor e | platinum bridge wire | chip resistor a |
| Impedance | R | 96 | 38 | 0.22 | 91 |
| | X | 49 | 11 | 17 | 15 |
| | X/R | 0.51 | 0.29 | 77.3 | 0.14 |
| Number of detonations/ Number of tested detonators | | 8/9 | 6/9 | 0/9 | 3/9 |

TABLE 4

| | | Comp. Example | |
|---|---|---|---|
| | | 5 | 6 |
| Antenna | | | |
| Type | | Half-wave-length dipole antenna | Loop antenna |
| Relative gain | | 0 | −0.5 |
| Radiation impedance | R | 71 | 21 |
| | X | 0 | 3 |
| | X/R | 0 | 0.14 |
| Transmission circuit | | | |
| Type | | coaxial cable I | coaxial cable II |
| Characteristic impedance | Z | 75 | 50 |
| Heating element | | | |
| Type | | platinum bridge wire | silver powder-containing heating element |
| Impedance | R | 0.22 | 64 |
| | X | 17 | 31 |
| | X/R | 77.3 | 0.54 |
| Number of detonations/ Number of tested detonators | | 0/9 | 0/9 |

What is claimed is:

1. A wireless detonator comprising:

an antenna for receiving microwaves, the antenna having a relative gain of 0 to 20 dB in a frequency band of microwaves;

a detonator including a heating element; and a transmission circuit for connecting the antenna to the heating element to directly transmit the microwave energy from the antenna to the heating element;

wherein an absolute value of a reactance component in a radiation impedance of the antenna is at most 50% of a pure resistance component of the radiation impedance, an absolute value of a reactance component in an impedance of the heating element is at most 50% of a pure resistance component of the impedance, and the pure resistance components of the radiation impedance of the antenna and of the impedance of the heating element are in a range of 70 to 130% of a characteristic impedance of the transmission circuit.

2. A wireless detonator according to claim 1, further comprising a printed circuit board, the antenna and the transmission circuit being formed on the same printed circuit board.

3. A wireless detonator according to claim 1, wherein the antenna is a Yagi antenna. .

4. A wireless detonator according to claim 1, wherein the microwaves have a frequency in the range of 2.3 to 2.6 GHz.

5. A wireless detonator according to claim 4, wherein the relative gain of the antenna is in the range of 6 to 7 dB.

6. A wireless detonator comprising:

an antenna for receiving microwaves, the antenna having a relative gain of 6 to 7 dB in a microwave frequency band of 2.3 to 2.6 GHz and being formed on a printed circuit board;

a detonator including a heating element; and a transmission circuit for connecting the antenna to the heating element to directly transmit the microwave energy from the antenna to the heating element, the transmission circuit being formed on the same printed circuit board as the antenna; wherein an absolute value of a reactance component in a radiation impedance of the antenna is at most 50% of a pure resistance component of the radiation impedance, an absolute value of a reactance component in an impedance of the heating element is at most 50% of a pure resistance component of the impedance, and the pure resistance components of the radiation impedance of the antenna and of the impedance of the heating element are in a range of 70 to 130% of a characteristic impedance of the transmission circuit.

* * * * *